US005593285A

United States Patent [19]

Watts

[11] Patent Number: 5,593,285

[45] Date of Patent: Jan. 14, 1997

[54] HYDRAULIC AXIAL PISTON UNIT WITH MULTIPLE VALVE PLATES

[75] Inventor: Thomas A. Watts, Ottawa, Ill.

[73] Assignee: Caterpillar Inc., Peoria, Ill.

[21] Appl. No.: 372,623

[22] Filed: Jan. 13, 1995

[51] Int. Cl.[6] ..... F04B 1/20

[52] U.S. Cl. ..... 417/269; 417/312; 91/499

[58] Field of Search ..... 417/269, 312, 417/435, 439; 91/474, 499; 92/57

[56] References Cited

U.S. PATENT DOCUMENTS

| | | | |
|---|---|---|---|
| 3,523,678 | 8/1970 | Wright | 91/499 |
| 3,585,901 | 6/1971 | Moon, Jr. | 417/312 |
| 3,699,845 | 10/1972 | Ifield | 91/499 |
| 3,738,228 | 6/1973 | Harrison | 91/499 |
| 3,890,883 | 6/1975 | Rometsch et al. | 91/499 |
| 4,034,652 | 7/1977 | Huebner | 91/499 |
| 4,550,645 | 11/1985 | Beck, Jr. | 91/499 |
| 4,920,856 | 5/1990 | Berthold et al. | 91/499 |

FOREIGN PATENT DOCUMENTS

| | | | |
|---|---|---|---|
| 60-35185 | 2/1985 | Japan | 92/57 |

*Primary Examiner*—Timothy Thorpe
*Assistant Examiner*—William Wicker
*Attorney, Agent, or Firm*—John W. Grant

[57] ABSTRACT

An axial piston hydraulic unit has a valve plate assembly positioned between a head and a rotatable cylinder barrel. The assembly includes a pair of valve plates stacked together to function as a single valve plate. The valve plate assembly defines a restricted flow path for providing initial communication between an approaching piston bore of the rotatable barrel and an intake port and a discharge port extending through the pair of plates. A first portion of the flow path is defined in the valve plate adjoining the head and a second portion of the flow path is defined in the valve plate adjacent the barrel. The stacked valve plates are hydraulically held together by a pair of pressure balancing devices.

3 Claims, 3 Drawing Sheets

10
11
12
2
2
59
23
31
58
21
61
34
32
36
63
23
64
22
62
22
17
24
14
18
24
13
28
27
26
16

HYDRAULIC AXIAL PISTON UNIT WITH MULTIPLE VALVE PLATES

TECHNICAL FIELD

This invention relates generally to hydraulic axial piston units and more particularly to one having a device for gradually increasing fluid communication between the piston bores in a rotatable barrel and intake and discharge passages in the housing.

BACKGROUND ART

Axial piston hydraulic pumps and motors commonly have a hardened valve plate stationarily positioned between a portion of the housing and a rotatable barrel. The valve plate has a plurality of kidney shaped ports extending therethrough for fluid communication between the piston bores of the barrel and intake and discharge passages in the head. The valve plates also typically have metering slots or grooves at the leading edge of the kidney ports for gradually increasing fluid communication between the piston bores and the respective intake and discharge passages in a manner which decreases hydraulic shock to alleviate noise and cavitation.

The valve plate of one such pump is made relatively thin so that the slots can be stamped to expedite the manufacturing process of the valve plates. A portion of the head forms the bottom of the slot. One of the disadvantages found with such thin valve plates is that the thickness of the valve plate is one of the factors determining the size of the orifice area of the metering slot. This limits the flexibility of controlling the orifice area as the piston bores open into the intake or discharge passages. It has also been found that high stresses are induced in the valve plate if the proper relationship of the plate thickness and slot size is not used.

Thus, it would be desirable to utilize the advantages of the thin valve plate design within a hydraulic axial piston unit while permitting a wider variety of metering slot geometries to be used for optimizing the operating characteristics of the axial piston unit.

The present invention is directed to overcoming one or more of the problems as set forth above.

DISCLOSURE OF THE INVENTION

In one aspect of the present invention, an axial piston hydraulic unit includes a head having intake and discharge passages therein, a rotatable barrel having a plurality of equally spaced circumferentially arranged piston bores opening toward the head, and a valve plate assembly positioned between the head and the barrel and secured against rotation relative to the head. The valve plate assembly has at least two valve plates stacked together to function as a single valve plate and has axially aligned arcuate shaped intake ports and axially aligned arcuate shaped discharge ports extending therethrough to selectively sequentially serially communicate the piston bores with the intake and discharge passages as the barrel rotates. The valve plate assembly defines a restricted flow path between the head and the end of the barrel for establishing initial communication between an approaching piston bore and one of the discharge or intake ports wherein a first portion of the flow path is defined in the plate adjacent the head and a second portion of the flow path is defined in the plate adjacent the barrel.

BEST MODE FOR CARRYING OUT THE INVENTION

Figure 1:
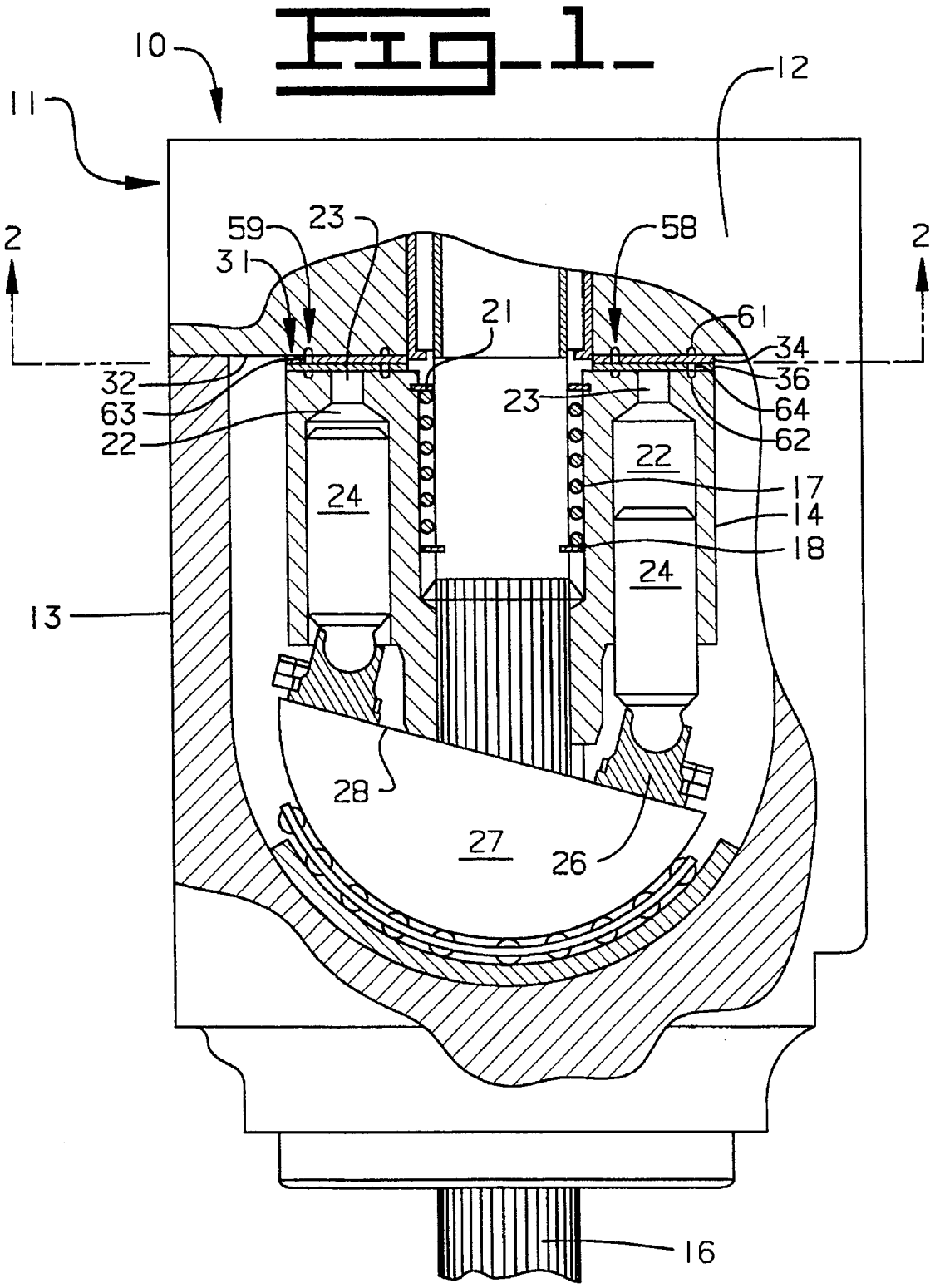
FIG. 1 is a longitudinal sectional view of an axial piston pump incorporating an embodiment of the present invention.

An axial piston hydraulic unit 10 includes a multi-piece housing 11 having a head 12 suitably attached to a casing 13. The hydraulic unit 10 may be either a pump or a motor and has a rotatable barrel 14 disposed within the housing and secured to a shaft 16 suitably mounted for rotation about a longitudinal axis. The barrel is resiliently biased toward the head 12 by a spring 17 disposed between a ring 18 secured to the shaft and a ring 21 secured to the barrel. The barrel has a plurality of equally spaced circumferentially arranged piston bores 22 each of which has a conventional kidney slot 23 opening toward the head. A plurality of pistons 24 are individually reciprocatably positioned within the piston bores 22. A slipper 26 is conventionally swivably connected to an end of each piston. A swashplate 27 is positioned within the housing and has a planar cam surface 28 engaged by the slippers to reciprocate the pistons within the piston bores in a conventional manner.

A valve plate assembly 31 is positioned between the barrel and a planar surface 32 of the head 12 and is secured against rotation relative to the head by a pair of pins 33. The valve plate assembly includes a pair of valve plates 34,36 stacked together to function as a single valve plate. The valve pirates have axially aligned arcuate shaped intake ports 37 continuously communicating with an intake passage 39 in the head and a plurality of arcuate shaped discharge ports 41–43 continuously communicating with a discharge passage 47 to selectively sequentially serially communicate the piston bores with the intake and discharge passages as the barrel rotates. Assuming that the barrel rotates clockwise relative to the valve plate assembly as viewed in FIG. 2, the intake ports 37 have a leading edge 48. The discharge port 41 would be the leading discharge port and have a leading edge 49.

The valve plates 34,36 define a restricted flow path 50 between the head and the end of the barrel for establishing initial communication between an approaching piston bore and the intake port 37. Similarly, the valve plate assembly 31 defines a restricted flow path 51 for establishing initial communication between an approaching piston bore and the discharge port 41. In this embodiment, the restricted flow paths are substantially identical and only the flow path 50 will be described in detail with common reference numerals applied to the flow path 51. A first portion of the flow path is defined by a first slot 52 in the plate 34 adjoining the head 12. A second portion of the flow path is defined by a second slot 53 in the plate 36 adjoining the barrel 14. The first slot opens into the intake port 37 and extends a predetermined distance from the leading edge 48 thereof. The second slot 53 also opens into the intake port and extends from the leading edge a distance greater than the predetermined distance of the first opening. Another portion of the flow path is defined by an elongate aperture 54 extending through the plate 34 and being circumferentially spaced from the first slot 52. A portion of the elongate aperture 54 opens into the second slot 53 to define a fixed size orifice 56. Another portion of the flow path is defined by an aperture 57 in the plate 36 and continuously communicating with the elongate aperture 54.

Figure 6:
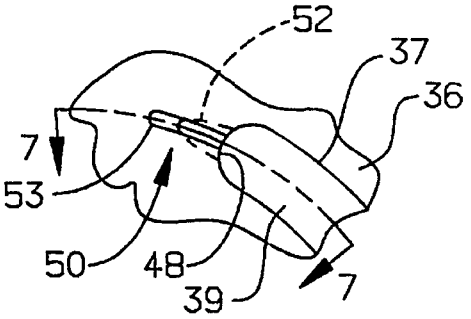
FIG. 6 is a plane view of an alternate embodiment of the present invention.
Figure 7:
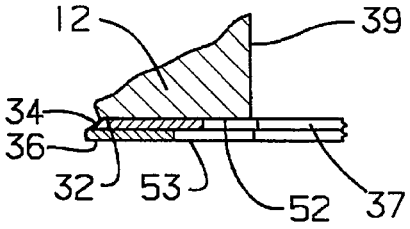
FIG. 7 is a sectional view taken along line 7—7 of FIG. 6.

An alternate embodiment of the flow path 50 is disclosed in FIGS. 6 and 7. It is noted that the same reference numerals of the first embodiment are used to designate similarly constructed counterpart elements of this embodiment. In this embodiment, however, the flow path includes only first and second slots 52,53 both of which open into the intake port 37. Moreover, in this embodiment the predetermined distance that the opening 52 extends from the leading edge 48 is somewhat greater than the predetermined distance in the first embodiment.

The stacked valve plates 34,36 are hydraulically held together by inner and outer concentric pressure balancing devices 58 and 59 positioned radially inwardly and outwardly of the intake and discharge ports. The pressure balancing devices are substantially identical in design and function and only the outer pressure balancing device will be described in detail. The outer pressure balancing device includes an annular drain groove 61 in the head 12 facing the valve plate 34, an annular drain groove 62 in the barrel 14 facing the plate 36, an annular array of circumferentially spaced arcuate pressure balancing slots 63 extending through the plate 34 and continuously communicating with the drain groove 61, and an annular array of circumferentially spaced pressure balancing slots 64 extending through the valve plate 36 and continuously communicating with the groove 62 and the slots 63. Preferably the slots 63 are offset relative to the slots 64 so that each pressure balancing slot in the plate 34 continuously communicates with a pair of the pressure balancing slots in the plate 36.

The valve plates can be relatively thin for simplifying the manufacturing process. For example, the thickness in one embodiment is about 1.6 mm such that the openings through the valve plates can be easily made by stamping. Since stamping becomes somewhat difficult when the width of the openings is less than the thickness of the plate, the use of thin valve plates permits extremely narrow openings to be stamped therein thereby increasing the ability to optimize the slot configuration for improved operating characteristics. While only two plates are shown in this embodiment, three or more thinner valve plates may alternatively be stacked together to function as a single valve plate.

Industrial Applicability

Figure 2:
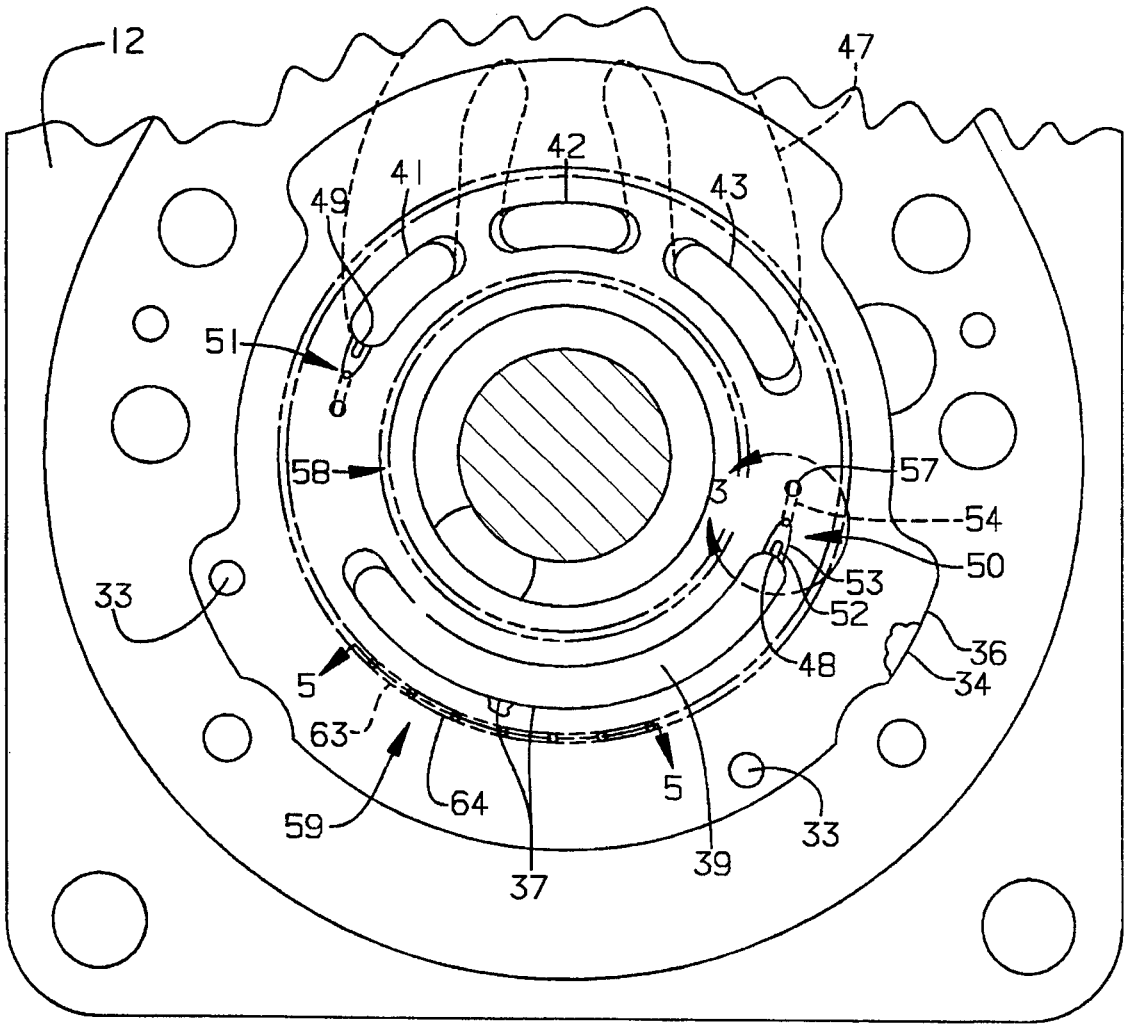
FIG. 2 is a sectional view taken along line 2—2 of FIG. 1.
Figure 3:
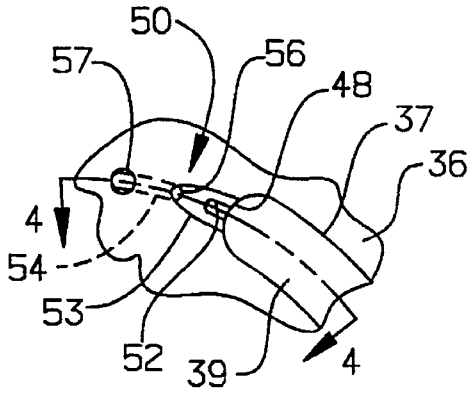
FIG. 3 is an enlarged plane view of a portion of FIG. 2 enclosed by line 3.
Figure 4:
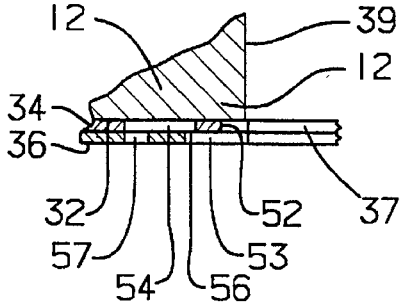
FIG. 4 is a sectional view taken along line 4—4 of FIG. 3.
Figure 5:
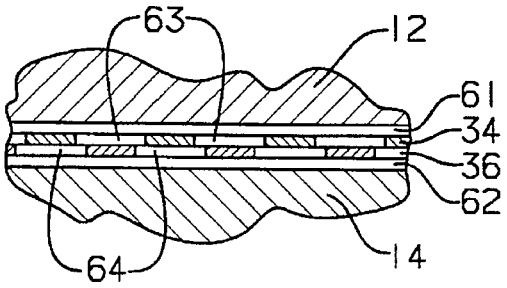
FIG. 5 is a sectional view taken along line 5—5 of FIG. 2.

The operation of the present embodiment will be described as if the barrel 14 rotates clockwise relative to the valve plate assembly 31 as viewed in FIG. 2 so that the kidney slots 23 of the piston bores 22 in the barrel sequentially communicate with the intake port 37 and the discharge ports 41–43. As the leading edge of each kidney slot approaches the leading edge 48, for example of the intake port, the initially communication between the piston bores and the intake passage 39 is through the flow path 50. Fluid flow through the flow path is restricted by the orifice 56 until the kidney slot opens directly into the second slot 53. At that time, the fluid flow through the flow path progressively increases until the kidney slots open directly into the intake port. This allows the fluid pressure in the piston bore to substantially equalize prior to the kidney slot opening into the intake port. The initial communication between the kidney slots and the discharge passage 47 occurs in a similar manner through the flow path 51.

Referring now to the alternate embodiment of FIGS. 6 and 7, the initial communication between the piston bores and the intake passage is through the slots 53 and 52. It is readily apparent that the initial opening area between the respective kidney slot and the slot 53 is very small and progressively increases until the kidney slot becomes fully communicative with the slot 53 prior to the kidney slot opening into the intake port.

The geometry of the flow path determines the characteristics of the piston pressure as initial communication is established between the piston bores and the intake and discharge passages. The term geometry includes sizes and shapes of the slots 52,53, the apertures 54,57, the size of the orifice 56, and so forth. Thus, it is readily apparent that the use of two stacked valve plates provide increased flexibility in selecting the geometry of the flow path to optimize the pressure characteristics for each hydraulic unit configuration.

The pressure balancing devices 58,59 function by collecting any leakage flow that may leak from the high pressure discharge ports either inwardly or outwardly between the plate assembly and the barrel or head and distributes the pressure substantially evenly in annular paths prior to being discharged into the housing.

Other aspects, objects, and advantages of this invention can be obtained from a study of the drawings, the disclosure, and the appended claims.

I claim:

1. An axial piston hydraulic unit comprising:

a head having an intake passage and a discharge passage therein;

a rotatable cylinder barrel having a plurality of equally spaced circumferentially arranged piston bores opening toward the head;

a valve plate assembly positioned between the head and the barrel and secured against rotation relative to the head, the valve plate assembly having at least two valve plates stacked together to function as a single valve plate, the valve plates having an arcuate shaped intake port and an arcuate shaped discharge port extending therethrough to selectively serially communicate the piston bores with the intake and discharge passages as the barrel rotates, the valve plates defining a restricted flow path between the head and the end of the barrel for establishing initial communication between an approaching piston bore and one of the discharge and intake ports, wherein a first portion of the flow path is defined in the valve plate adjoining the head and a second portion of the flow path is defined in the plate adjacent the barrel, wherein the first portion of the flow path includes a first slot in the valve plate adjoining the head and extending a predetermined distance from the one port, and the second portion includes a second slot in the valve plate adjacent the barrel and opening into the one port, the second slot extending from the one port a distance greater than said predetermined distance.

2. The hydraulic unit of claim 1, wherein said flow path includes an elongate aperture extending through the valve plate adjoining the head and circumferentially spaced from the first slot, and an aperture extending through the plate adjacent the barrel and continuously communicating with the elongate aperture, the elongate slot having a portion thereof continuously communicating with the second slot to define a flow metering orifice between the elongate aperture and the second slot.

3. An axial piston hydraulic unit comprising:

a head having an intake passage and a discharge passage therein;

a rotatable cylinder barrel having a plurality of equally spaced circumferentially arranged piston bores opening toward the head;

a valve plate assembly positioned between the head and the barrel and secured against rotation relative to the head, the valve plate assembly having at least two valve plates stacked together to function as a single valve plate, the valve plates having an arcuate shaped intake port and an arcuate shaped discharge port extending therethrough to selectively serially communicate the piston bores with the intake and discharge passages as the barrel rotates, the valve plates defining a restricted flow path between the head and the end of the barrel for establishing initial communication between an approaching piston bore and one of the discharge and intake ports, wherein a first portion of the flow path is defined in the valve plate adjoining the head and a second portion of the flow path is defined in the plate adjacent the barrel, the head including an annular drain groove opening toward the valve plate adjoining the head and the barrel includes an annular groove opening toward the valve plate adjacent the barrel, wherein the valve plate adjoining the head has an array of circumferentially spaced pressure balancing slots extending therethrough in communication with the annular drain groove in the head, and the valve plate adjacent the barrel has an array of circumferentially spaced pressure balancing slots in communication with the annular groove in the barrel, the pressure balancing slots in the plate adjoining the head being offset relative to the pressure balancing slots in the plate adjoining the barrel so that each pressure balancing slot in one plate continuously communicates with a pair of the pressure balancing slots in the other plate.

* * * * *